US006640502B2

(12) United States Patent
Mueller

(10) Patent No.: US 6,640,502 B2
(45) Date of Patent: Nov. 4, 2003

(54) CEILING LEAK CAPTURE AND DRAINAGE SYSTEM

(76) Inventor: Stephen M. Mueller, 541 Radix Rd., Williamstown, NJ (US) 08094

( * ) Notice: Subject to any disclaimer, the term of this patent is extended or adjusted under 35 U.S.C. 154(b) by 37 days.

(21) Appl. No.: 10/082,408

(22) Filed: Feb. 26, 2002

(65) Prior Publication Data

US 2003/0159383 A1 Aug. 28, 2003

(51) Int. Cl.[7] ..... E04B 5/52; E04D 13/00

(52) U.S. Cl. ..... 52/22; 52/14; 52/127.5; 52/169.5; 52/302.1; 52/483.1; 52/489.1; 52/482; 52/506.6; 52/506.9; 52/509; 52/510; 52/533; 52/553; 52/558; 52/713; 52/792.1; 137/1; 137/140; 137/312; 137/350; 137/356; 137/357; 137/359; 240/9

(58) Field of Search ..... 52/22, 14, 483.1, 52/489.1, 169.5, 533, 534, 558, 560, 792.1, 302.1, 302.3, 482, 127.5, 656.1, 713, 506.06, 506.07, 509, 510, 506.09, 733.1, 553; 240/9; 137/1, 140, 312, 350, 356, 357, 359

(56) References Cited

U.S. PATENT DOCUMENTS 1,501,739 A * 7/1924 Benedek ..... 4/661
1,991,772 A * 2/1935 Rieger et al. ..... 210/166
2,410,338 A * 10/1946 Craine ..... 52/198
2,546,394 A * 3/1951 Harmon ..... 428/169
2,619,920 A * 12/1952 Lindquist ..... 52/302.1
2,733,684 A * 2/1956 Trenchard ..... 119/526
2,913,571 A * 3/1959 Smith ..... 362/149
3,082,032 A * 3/1963 Stata ..... 296/97.23
3,418,766 A * 12/1968 Jackson ..... 52/83
3,490,602 A * 1/1970 Wentzel ..... 211/133.6
3,498,015 A * 3/1970 Seaburg et al. ..... 52/310
3,504,463 A * 4/1970 Akerson ..... 52/145
3,583,522 A * 6/1971 Rohweder et al. ..... 181/290
3,606,617 A * 9/1971 Frazier ..... 4/613
3,782,495 A * 1/1974 Nassof ..... 181/284
3,831,328 A * 8/1974 Mohr et al. ..... 52/145
3,859,770 A * 1/1975 Chambers et al. ..... 52/745.05
4,189,888 A * 2/1980 Blitzer, Jr. ..... 52/506.07
4,205,662 A * 6/1980 Rhodes et al. ..... 126/672
4,243,214 A * 1/1981 LaRooka ..... 5/630
4,245,666 A * 1/1981 Norris ..... 137/357
4,257,205 A * 3/1981 Kuhr ..... 52/506.08
4,258,701 A * 3/1981 Buckley ..... 126/642

(List continued on next page.)

*Primary Examiner*—Carl D. Friedman
*Assistant Examiner*—Christy Green
(74) *Attorney, Agent, or Firm*—Norman E. Lehrer

(57) ABSTRACT

A fluid leak capture and drainage system for ceiling leaks which includes a ceiling panel support grid and a plurality of ceiling panels mounted thereon is disclosed. The ceiling panel has a raised platform located in the center of the panel and a wall extending along the periphery of the panel so that a perimeter trough is formed between the platform and the wall. The wall has a top edge and a rim extending outwardly and generally perpendicularly from the top edge of the wall and at least one opening formed through the wall. A fitting is connected to the opening and tubing is attached to the fitting for draining the trough as fluid collects therein.

6 Claims, 4 Drawing Sheets

U.S. PATENT DOCUMENTS 4,291,423 A * 9/1981 Wilson ..... 4/598
D262,104 S * 12/1981 Simpson ..... D13/119
4,313,457 A * 2/1982 Cliff ..... 137/312
4,317,996 A * 3/1982 Davis ..... 250/302
4,353,356 A * 10/1982 Vandenbossche ..... 126/648
4,426,999 A * 1/1984 Evans et al. ..... 126/669
4,471,764 A * 9/1984 Calvert et al. ..... 126/704
4,481,975 A * 11/1984 Buckley ..... 137/561 A
4,541,132 A * 9/1985 Long ..... 4/614
4,577,713 A * 3/1986 Moon ..... 180/69.1
4,633,899 A * 1/1987 Lord ..... 137/357
4,635,710 A * 1/1987 Shelley ..... 165/49
4,765,360 A * 8/1988 Baird ..... 137/312
4,817,343 A * 4/1989 Rutledge ..... 52/22
4,860,502 A * 8/1989 Mickelsen et al. ..... 52/11
D304,498 S * 11/1989 Carey ..... D25/58
4,903,723 A * 2/1990 Sublett ..... 137/312
4,946,484 A * 8/1990 Monson et al. ..... 55/385.2
5,008,652 A * 4/1991 Woloszyk ..... 340/605
5,133,167 A * 7/1992 Drew et al. ..... 52/506.08
5,143,178 A * 9/1992 Latham, Jr. ..... 184/106
5,144,782 A * 9/1992 Paquette et al. ..... 52/408
5,172,718 A * 12/1992 Thornburgh ..... 137/312
5,176,161 A * 1/1993 Peters et al. ..... 137/15.08
5,179,969 A * 1/1993 Peterson ..... 137/1
5,195,281 A * 3/1993 Kosko ..... 52/11
5,207,035 A * 5/1993 Fowler ..... 52/22
5,261,130 A * 11/1993 Kendall ..... 4/613
5,289,664 A * 3/1994 Rizza et al. ..... 52/302.1
5,299,591 A * 4/1994 Duncan ..... 137/15.11
5,317,852 A * 6/1994 Howland ..... 52/408
5,363,908 A * 11/1994 Koster ..... 165/49
D354,117 S * 1/1995 Nations ..... D23/283
5,452,739 A * 9/1995 Mustee et al. ..... 137/312
5,526,900 A * 6/1996 Mason ..... 184/106
5,598,678 A 2/1997 Reynolds
5,615,526 A * 4/1997 Palmer et al. ..... 52/302.1
5,645,103 A * 7/1997 Whittaker ..... 137/312
5,765,328 A * 6/1998 Moore ..... 52/302.1
5,836,344 A * 11/1998 Hovi, Sr. ..... 137/357
D431,958 S * 10/2000 Harris ..... D7/354
6,185,889 B1 * 2/2001 Gilgan et al. ..... 52/302.1
6,216,811 B1 * 4/2001 Herc ..... 180/68.5
6,279,271 B1 * 8/2001 Burkart, Jr. ..... 52/11
6,283,144 B1 * 9/2001 Kahn ..... 137/357
D452,903 S * 1/2002 Whitsitt ..... D23/322
6,378,639 B1 * 4/2002 Murray ..... 180/69.1
6,539,912 B1 * 4/2003 Beer ..... 123/196

* cited by examiner

CEILING LEAK CAPTURE AND DRAINAGE SYSTEM

BACKGROUND OF THE INVENTION

The present invention is directed toward a fluid leak capture and drainage system and more particularly, toward a system which will protect furniture, computer equipment, and the like from damage caused by leaks from a ceiling.

Suspended or hung ceilings are often used in businesses and offices and are used to finish and conceal the space between the ceiling and the roof or floor above which is used for air conditioning and heating ducts, electrical conduits, and piping. Leaks may occur from the aforementioned elements, from an opening in the roof of the building, or from faulty plumbing or the like. If a proper leak capture and drainage system is not in place during a leak, computer equipment, electronic devices, documents, furniture, and the like are likely to get damaged.

Many attempts to solve this problem have been proposed. For example, U.S. Pat. No. 4,817,343 to Rutledge discloses a leak-proof ceiling system which includes a pair of elongated longerons suspended beneath the roof. Troughs are suspended between the longerons. Each longeron has a shield member so that fluid contacts the shield member and is directed into the trough. A drainage system empties the troughs as they get filled. This device, however, cannot be installed into an existing ceiling and would therefore, be somewhat limited in its versatility and usefulness.

Also, U.S. Pat. No. 5,299,591 to Duncan discloses a device for containing leaks above suspended ceilings. This device includes a receptacle which replaces a regular ceiling panel and is installed on the grid structure of the suspended ceiling. Fluid accumulates in the receptacle and is drained via an attached hose. However, because of the shape of the device, it may not be able to withstand significant leaks and thus, may not perform very effectively.

Other relevant inventions are shown in U.S. Pat. No. 5,133,167 to Drew et al. and U.S. Pat. No. 5,172,718 to Thornburgh. These inventions, however, do not appear to provide very effective drainage systems.

SUMMARY OF THE INVENTION

The present invention is designed to overcome the deficiencies of the prior art discussed above. It is an object of the present invention to provide a drainage system which will protect furniture, computer equipment, and the like from damage caused by leaks from a ceiling.

It is another object of the present invention to provide a drainage system which can be installed easily in an existing suspended ceiling.

It is a further object of the present invention to provide a drainage system which includes a ceiling panel that maximizes fluid flow while minimizing the weight of the collected fluid and distributes the weight produced by the collection of fluid within the panel in an efficient manner.

In accordance with the illustrative embodiments demonstrating features and advantages of the present invention, there is provided a drainage system for ceiling leaks which includes a ceiling panel support grid and a plurality of ceiling panels mounted thereon. The ceiling panel has a raised platform located in the center of the panel and a wall extending along the periphery of the panel so that a perimeter trough is formed between the platform and the wall. The wall has a top edge and a rim extending outwardly and generally perpendicularly from the top edge of the wall and at least one opening formed through the wall. A fitting is connected to the opening and tubing is attached to the fitting for draining the trough as fluid collects therein.

Other objects, features, and advantages of the invention will be readily apparent from the following detailed description of a preferred embodiment thereof taken in conjunction with the drawings.

BRIEF DESCRIPTION OF THE DRAWINGS

For the purpose of illustrating the invention, there is shown in the accompanying drawings one form which is presently preferred; it being understood that the invention is not intended to be limited to the precise arrangements and instrumentalities shown.

DETAILED DESCRIPTION OF THE PREFERRED EMBODIMENT

Figure 1:
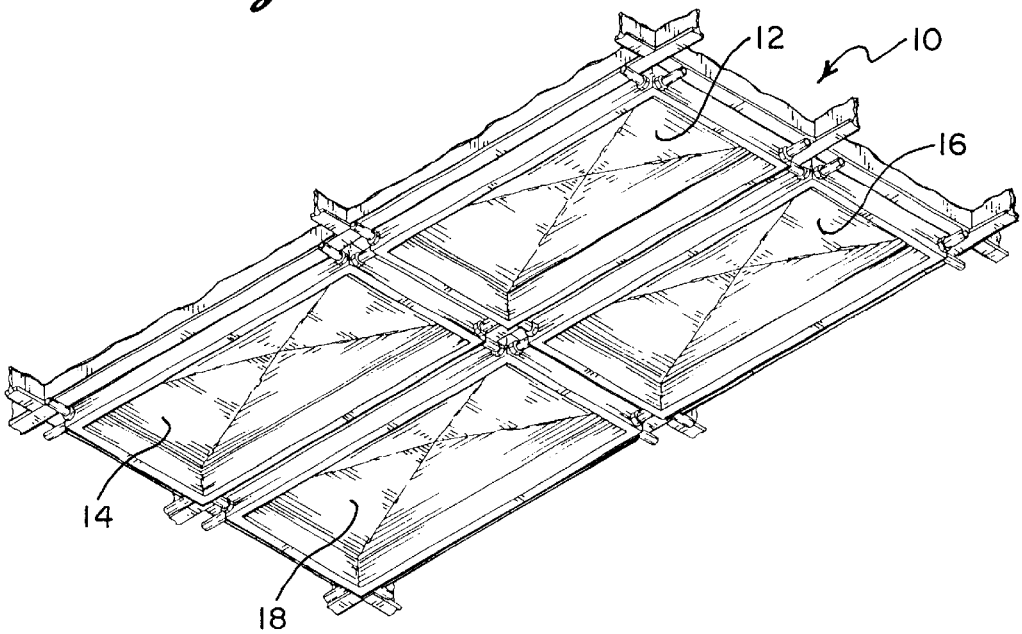
FIG. 1 is a bottom perspective view of the ceiling panels of the present invention placed within a ceiling panel support grid.

Referring now to the drawings in detail wherein like reference numerals have been used throughout the various figures to designate like elements, there is shown in FIG. 1 a drainage system constructed in accordance with the principles of the present invention and designated generally as 10.

Figure 6:
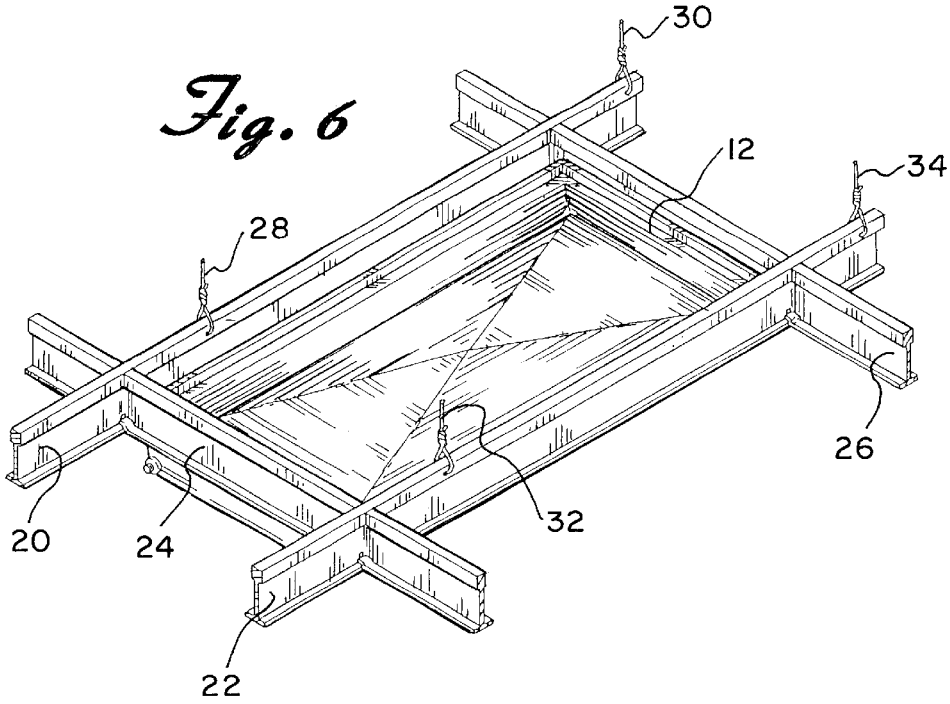
FIG. 6 is a top perspective view of a ceiling panel of the present invention placed within a ceiling panel support grid without a cap.

The drainage system essentially includes a ceiling panel support grid and a plurality of ceiling panels 12, 14, 16, and 18 mounted thereon. The support grid consists of main hanger beams 20 and 22 and intermediate hanger beams 24 and 26 which form a grid. The grid is suspended by wire supports 28, 30, 32, and 34 which extend from a connector attached to above-ceiling support structures (not shown) to attachment means on the main hanger beams 20 and 22, such as apertures formed within the beams. (See FIG. 6.) As is known in the art, the support grid beams 20, 22, 24 and 26 are in the shape of an inverted "T" structure. (See, for example, beam 22 of FIG. 2.)

Figure 3:
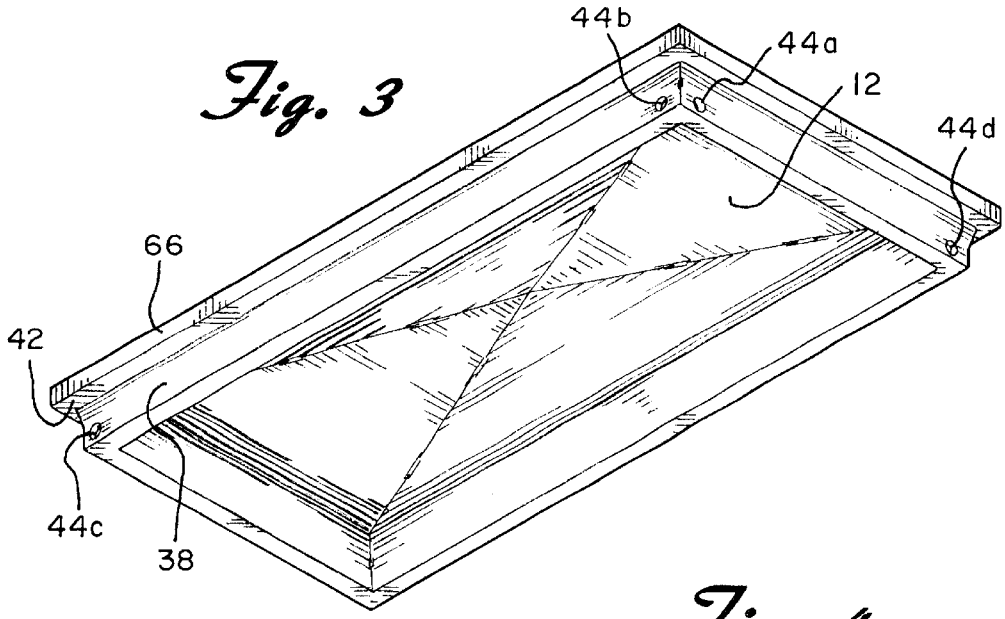
FIG. 3 is a bottom perspective view of a ceiling panel of the present invention.
Figure 4:
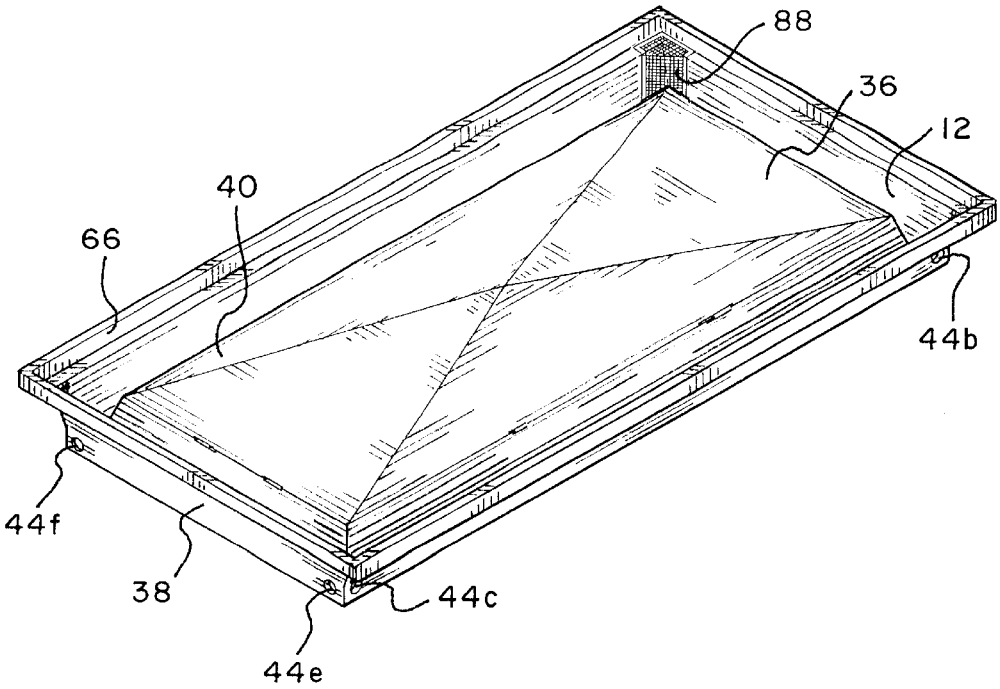
FIG. 4 is a top perspective view of a ceiling panel of the present invention.

While the system of the present invention includes a plurality of identical ceiling panels, only one will be described in detail it being understood that the others are constructed in substantially the same manner. The ceiling panel 12 has a raised platform 36 located in the center of the panel 12 and a wall 38 extending along the periphery of the panel so that a trough 40 is formed between the platform 36 and the wall 38. (See FIG. 4.) The wall 38 has a top edge and a rim 42 extending outwardly and generally perpendicularly from the top edge of the wall and at least one opening 44*a* formed through the wall 38. Several openings 44*b*–44*f* may be located within the wall 38 at various locations, generally near the corners of each of the panels. However, not all of the openings need to be used for the drain. That is, the openings may be punched out so that only the opening or openings that are needed are exposed. (See FIGS. 3 and 4.)

The panel 12 is sized to fit in a standard two foot by four foot or two foot by two foot ceiling grid via rim 42 resting on the T-shaped structure of the grid. (See FIG. 2.) The shape of the ceiling panel allows fluid to collect along the perimeter of the panel, that is, within the trough 40, thereby evenly distributing the weight of the fluid being collected. The shape of the trough 40, relatively narrow with respect to depth, also allows for a maximum of developed fluid head with a minimum of fluid weight. Each panel may be made from painted steel, stainless steel, aluminum, plastic, coated fiberboard, or the like.

Figure 2:
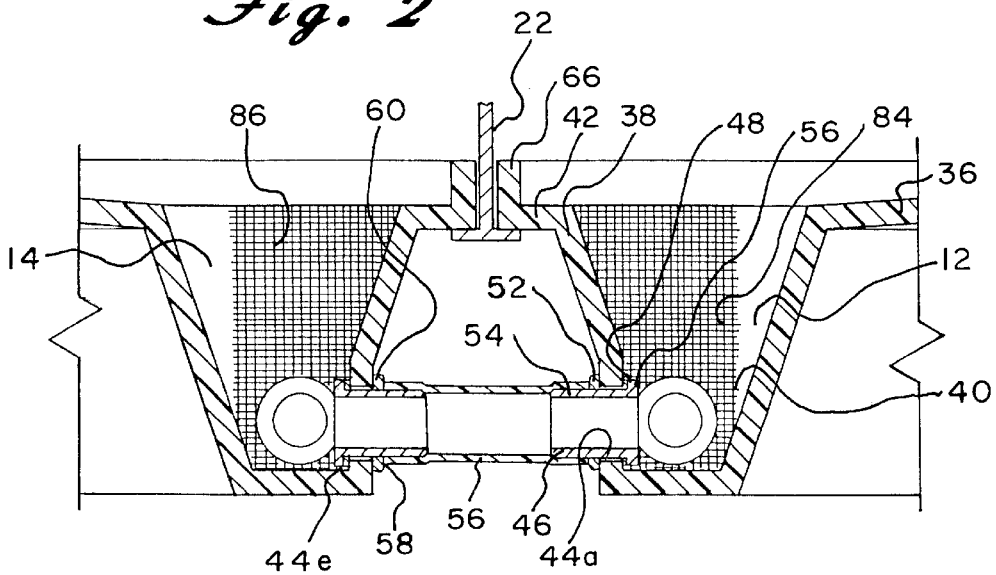
FIG. 2 is a cross-sectional view of the ends of two of the ceiling panels of the present invention connected together.
Figure 5:
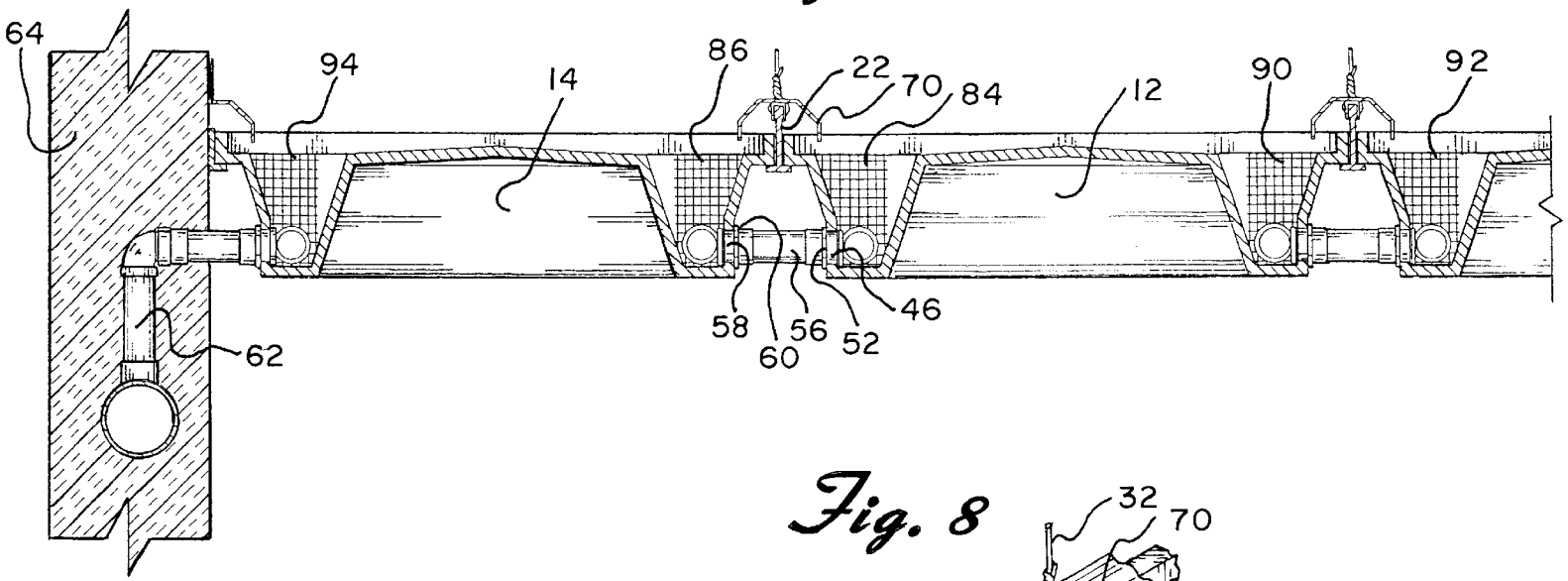
FIG. 5 is a cross-sectional view of several of the ceiling panels of the present invention connected together and supported by a ceiling panel support grid.

Pipe fittings are used to connect the panels to each other. As shown in FIG. 2, a pipe 46 fits within opening 44*a* of panel 12. One end 48 of the pipe 46 has a flange 50 which abuts the interior side of the wall 38 of the panel 12. A ring gasket or O-ring may fit between the wall 38 and the flange 50 in order to insure a water tight fit. A nut 52 is threaded onto the opposite or exposed end 54 of the pipe 46. An elastomeric hose or tube 56 is placed over the exposed end 56 of the pipe 46. Similarly, a pipe 58 fits within an opening 44*e* in panel 14 and is held in place with nut 60. Hose 56 also fits over the exposed end of the pipe 58. In this manner, the panels 12 and 14 via the pipes 46 and 58 and hose 54 are in fluid communication with each other. This same arrangement continues throughout the entire system. (See FIG. 5.) As fluid collects within the panels, it is drained though the pipes and hoses. A pipe or hose 62 may be attached to a panel closest to a room wall 64 to which all of the other panels drain.

Figure 8:
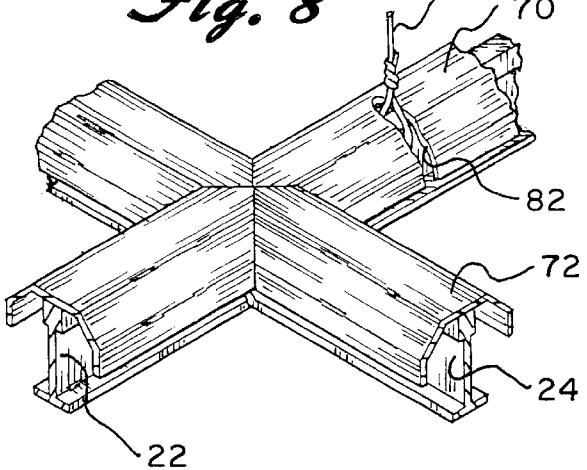
FIG. 8 is a top perspective view of the caps of the present invention placed over the T-shaped structure of a ceiling panel support grid.
Figure 7:
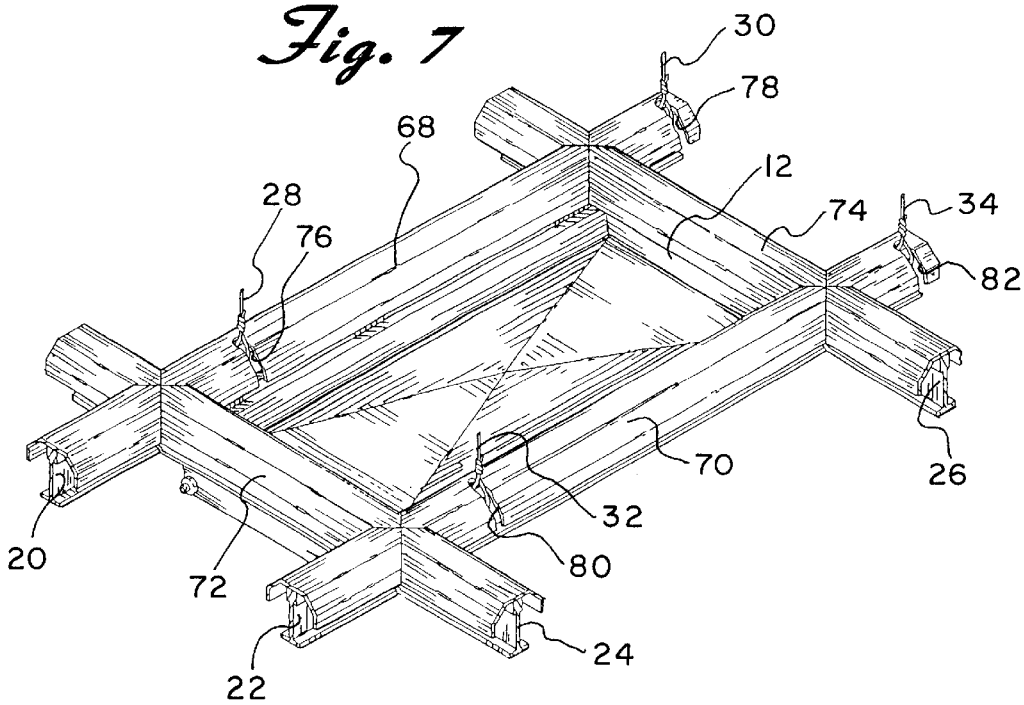
FIG. 7 is a top perspective view of a ceiling panel of the present invention placed within a ceiling panel support grid with caps in place.

A flange 66 extends vertically upwardly from the rim 42 of the wall 38 of the panel 12 and rests on the T-shaped structure of the grid. (See FIG. 2.) The flange 66 or rim 42 may have openings formed therein in order to force overflow into a certain area in the highly unlikely event that the trough 40 does not drain and floods. Caps 68, 70, 72, and 74 are mounted between adjacent panels and extend over the T-shaped structure. (See FIGS. 7 and 8.) Each cap, for example, caps 68 and 70 may have a number of cut outs 76, 78, 80, and 82, for example, formed therein in order to fit over wire attachments 28, 30, 32, and 34. (See FIG. 7.) The cap generally covers the rims and flanges of each of the panels. The cap intercepts and deflects fluid away from the rim of the panel and toward the drain. The joints between the caps and the various cut-outs in the caps are sealed with adhesive-backed, waterproof tape to provide a leak-tight assembly. Furthermore, mesh screens 84, 86, 88, 90, 92, and 94, for example, may be mounted within the trough adjacent the openings in order to prevent debris from clogging the drains. (See FIGS. 2, 4, and 5.)

Not all of the panels in a ceiling need to be replaced with the present invention, only the panels selected by the installer. In this manner, only the areas of the room that need the most protection from damage caused by leaks from the ceiling will be protected.

The present invention may be embodied in other specific forms without departing from the spirit or essential attributes thereof and accordingly, reference should be made to the appended claims rather than to the foregoing specification as indicating the scope of the invention.

I claim:

1. A fluid capture and drainage system for ceiling leaks comprising:

a ceiling panel support grid;

at least one ceiling panel having a raised platform located in the center of said panel and a wall extending along the periphery of said panel so that a trough is formed between said platform and said wall, said wall having a top edge and a rim extending outwardly and generally perpendicularly from said top edge of said wall and at least one opening formed through said wall, wherein said panel is mounted on said ceiling panel support grid;

a fitting connected to said at least one opening; and means for draining said trough as fluid collects therein attached to said fitting.

2. The fluid capture and drainage system of claim 1 further including a flange extending vertically upwardly from said rim of said wall.

3. The fluid capture and drainage system of claim 1 further including a plurality of said ceiling panels mounted on said ceiling panel support grid.

4. The fluid capture and drainage system of claim 3 wherein a cap is mounted between adjacent panels and generally covers the rims of each of said panels.

5. The fluid capture and drainage system of claim 1 further including at least one mesh screen mounted within said trough adjacent said opening.

6. The fluid capture and drainage system of claim 1 wherein said draining means includes an elastomeric hose.

* * * * *